US009776207B2

(12) United States Patent
Hargett et al.

(10) Patent No.: US 9,776,207 B2
(45) Date of Patent: Oct. 3, 2017

(54) METHODS AND ASSEMBLIES FOR APPLYING FLOWABLE SUBSTANCES TO SUBSTRATES

(71) Applicant: The Procter & Gamble Company, Cincinnati, OH (US)

(72) Inventors: Mark Mason Hargett, Liberty Township, OH (US); Gavin John Broad, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 20 days.

(21) Appl. No.: 14/270,570

(22) Filed: May 6, 2014

(65) Prior Publication Data

US 2014/0349021 A1 Nov. 27, 2014

Related U.S. Application Data

(60) Provisional application No. 61/827,122, filed on May 24, 2013.

(51) Int. Cl.
*B05D 1/28* (2006.01)
*B05C 1/08* (2006.01)

(52) U.S. Cl.
CPC ..... *B05D 1/28* (2013.01); *B05C 1/0808* (2013.01); *B05C 1/0813* (2013.01); *B05C 1/0817* (2013.01)

(58) Field of Classification Search
CPC ..... B05D 1/28
(Continued)

(56) References Cited

U.S. PATENT DOCUMENTS 581,056 A 4/1897 Bodkin
1,439,464 A 12/1922 Bowersock
(Continued)

FOREIGN PATENT DOCUMENTS

GB 2 345 756 A 7/2000
JP A-H9-276774 10/1997
(Continued)

OTHER PUBLICATIONS http:// unicornpetro.co.in/liquid_parafin.htm screen captured on Dec. 14, 2015.*
(Continued)

*Primary Examiner* — Nathan Empie
(74) *Attorney, Agent, or Firm* — Larry L. Huston; Steven W. Miller

(57) ABSTRACT

The present disclosure is directed, in part, to a method of applying a flowable substance to a substrate. The method comprises contacting a portion of the substrate with a portion of a rotating applicator as the substrate is conveyed, and immersing the portion of the rotating applicator in the flowable substance to accumulate the flowable substance on the portion of the rotating applicator. The method further comprises engaging a metering device with the portion of the rotating applicator, metering a portion of the accumulated flowable substance on the portion of the rotating applicator off of the portion of the rotating applicator using the metering device, and applying a portion of the remaining flowable substance on the portion of the rotating applicator to the portion of the substrate when the portion of the substrate contacts the portion of the rotating applicator.

9 Claims, 9 Drawing Sheets

(58) Field of Classification Search
USPC ..... 427/428.01, 428.14, 428.2
See application file for complete search history.

(56) References Cited

U.S. PATENT DOCUMENTS

| | | | | | |
|---|---|---|---|---|---|
| 2,775,953 | A | | 1/1957 | McFall | |
| 3,218,691 | A | * | 11/1965 | Carroll | D06B 1/14 68/200 |
| 3,312,191 | A | * | 4/1967 | Lowe | B05C 1/0808 118/104 |
| 3,401,670 | A | * | 9/1968 | Oxford, Jr. | D06B 1/141 118/212 |
| 3,706,489 | A | * | 12/1972 | Moxness | G03G 15/0935 355/64 |
| 3,796,186 | A | | 3/1974 | Bounds et al. | |
| 4,147,813 | A | | 4/1979 | Casey | |
| 4,241,690 | A | | 12/1980 | Muller | |
| 5,028,457 | A | * | 7/1991 | Kinose | B05C 1/0834 118/224 |
| 5,057,337 | A | * | 10/1991 | Makino | B23K 3/0692 118/227 |
| 5,478,599 | A | | 12/1995 | Iyer et al. | |
| 6,550,092 | B1 | * | 4/2003 | Brown | A47L 13/16 15/104.002 |
| 2001/0017104 | A1 | | 8/2001 | Choi et al. | |
| 2006/0147636 | A1 | | 7/2006 | Cooprider et al. | |
| 2014/0186538 | A1 | * | 7/2014 | Goto | A47L 13/38 427/428.01 |

FOREIGN PATENT DOCUMENTS

| | | |
|---|---|---|
| JP | A-H11-38237 | 2/1999 |
| JP | A-H11-99519 | 4/1999 |
| JP | A-H11-138534 | 5/1999 |
| JP | A-2003-341007 | 12/2003 |
| JP | A-2006-103992 | 4/2006 |
| JP | A-2010-246838 | 11/2010 |

OTHER PUBLICATIONS

PCT Search Report dated Oct. 23, 2014; PCT/US2014/038564; 11 pages.

* cited by examiner

METHODS AND ASSEMBLIES FOR APPLYING FLOWABLE SUBSTANCES TO SUBSTRATES

FIELD

The present disclosure generally relates to methods and assemblies for applying flowable substances to substrates.

BACKGROUND

Flowable substances are applied to many products, such as consumer products, during their manufacture. The flowable substances may comprise fluids, slurries, and/or suspensions, for example. The flowable substances may be applied to finished products, raw materials, or intermediate stage materials or products (i.e., partially finished materials or products) for various reasons.

The products that the flowable substances are being applied to may dictate the particular methods and applicator assemblies used for flowable substance application. One example flowable substance application method is spraying the flowable substance onto a product. In this instance, an assembly, such as a spray nozzle, may be employed.

Various cleaning articles, or portions thereof, are one example consumer product that may require flowable substance application during their manufacture. These cleaning articles may be used for dusting and light cleaning, for example, or for other purposes. Cleaning articles, such as disposable dusters, have been developed which have limited re-usability. These disposable dusters may comprise brush portions made of synthetic fiber bundles, called tow fibers, attached to one or more layers of material, such as one or more layers of a nonwoven material. In other instances, the tow fibers may be attached to a rigid material or plate. The disposable cleaning articles may be used for one job (e.g., several square meters of surface) and discarded, or may be restored and re-used for more jobs and then discarded.

Portions of, or all of, the consumer products may be coated with one or more flowable substances. In one instance, portions of substrates, or bundles or strips of tow fibers, of consumer products may be coated with the flowable substances or have the flowable substances applied thereto. The flowable substances may help the cleaning articles attract and pick-up dust and/or dirt, for example. One key to applying the flowable substances to consumer products is to provide the correct amount (i.e., not too much or too little). Another key aspect is to provide a substantially uniform amount of the flowable substance to a substrate. Previous flowable substance application methods and assemblies have generally been unable to properly apply a suitable amount of the flowable substances in a substantially uniform fashion. What is needed are methods and applicator assemblies for applying flowable substances to substrates, such as substrates comprising tow fibers, for example, in the correct amount and in a substantially uniform fashion.

SUMMARY

In one form, the present disclosure is directed, in part, to a method of applying a flowable substance to a substrate, such as a strip of tow fibers. The method may comprise conveying the substrate, contacting a portion or surface of the substrate with a portion of a rotating applicator as the substrate is conveyed, and immersing the portion or surface of the rotating applicator in the flowable substance to accumulate the flowable substance on the portion of the rotating applicator. The method may further comprise engaging a metering device with the portion of the rotating applicator. The metering device may comprise a plurality of grooves formed in a surface thereof. The method may further comprise metering a portion of the accumulated flowable substance on the portion of the rotating applicator off of the portion of the rotating applicator using the metering device, and applying a portion of the remaining flowable substance on the portion of the rotating applicator to the portion of the substrate when the portion of the substrate contacts the portion of the rotating applicator.

In another form, the present disclosure is directed, in part, to an applicator assembly configured to apply a flowable substance to a substrate, such as a strip of tow fibers. The applicator assembly may comprise a housing defining a reservoir therein. The reservoir is configured to receive the flowable substance. The applicator assembly may further comprise an applicator roll engaged with or positioned proximate to the housing. The applicator roll may be configured to rotate relative to the housing. A radial outer surface of the applicator roll may be configured to contact the flowable substance within the reservoir. The applicator assembly may further comprise a metering roll. A surface of the metering roll may be biased toward a portion of the radial outer surface of the applicator roll. The surface of the metering roll may have a plurality of circumferential grooves defined therein. Each groove may be spaced about 1 mm to about 15 mm from each other groove.

BRIEF DESCRIPTION OF THE DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION

Figure 1:
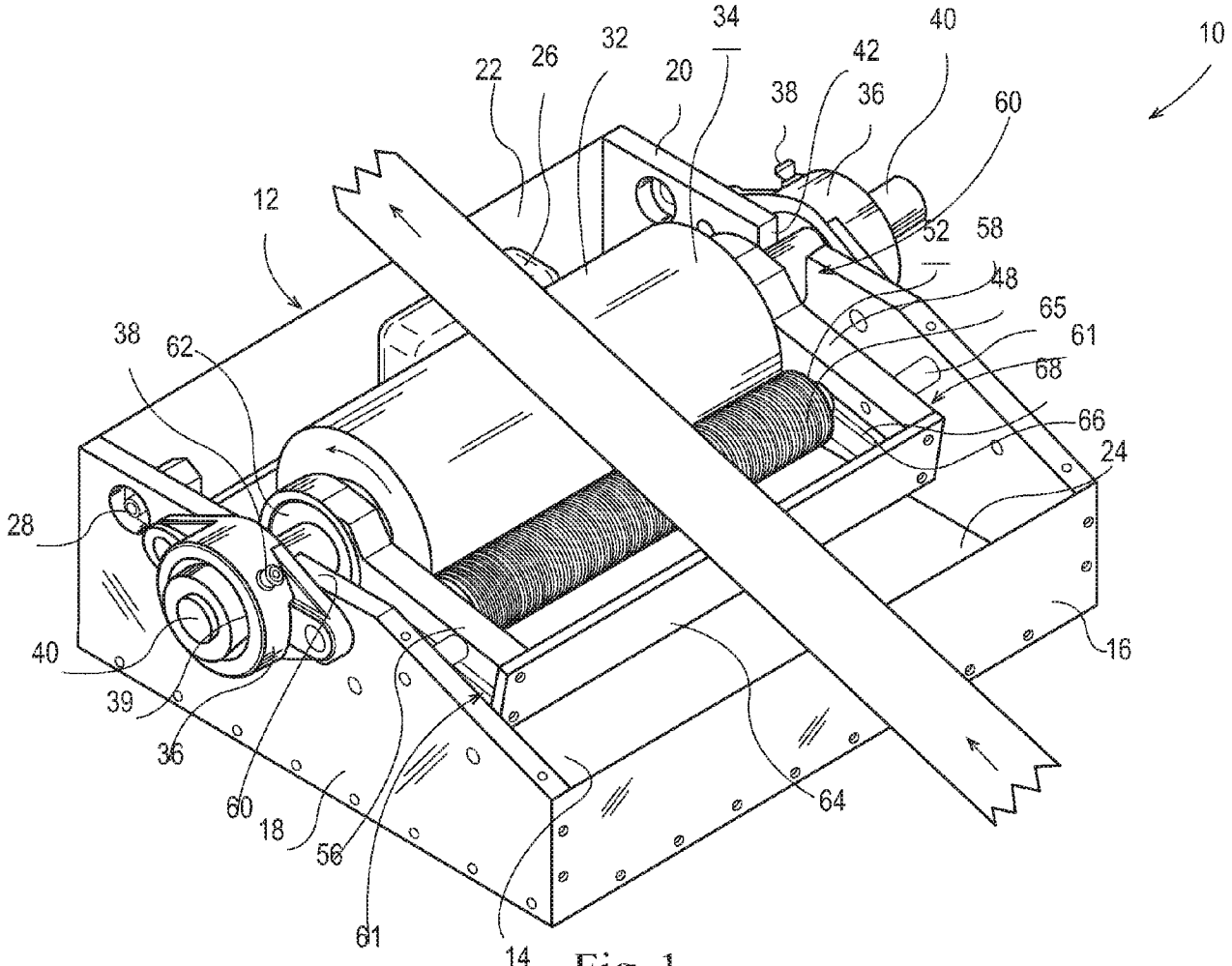
FIG. 1 is a perspective view of an applicator assembly configured to apply a flowable substance to one or more substrates in accordance with a non-limiting embodiment of the present disclosure.

Various non-limiting embodiments of the present disclosure will now be described to provide an overall understanding of the principles of the structure, function, manufacture, and use of the methods and assemblies for applying flowable substances to substrates disclosed herein. One or more examples of these non-limiting embodiments are illustrated in the accompanying drawings. Those of ordinary skill in the art will understand that the methods and assemblies for applying flowable substances to substrates described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

Definitions:

The terms "joined," "attached," "mounted," "engaged," or "engaged with" encompass configurations wherein an element is directly secured to another element by affixing the element directly to the other element, and configurations wherein an element is indirectly secured to another element by affixing the element to intermediate member(s) which in turn are affixed to the other element.

The term "nonwoven" or "nonwoven material" refers herein to a material made from continuous (long) filaments (fibers) and/or discontinuous (short) filaments (fibers) by processes such as spunbonding, meltblowing, carding, and the like. Nonwovens do not have a woven or knitted filament pattern.

The term "machine direction" (MD) is used herein to refer to the primary direction of material, strip of substrate, or article flow through a process.

The term "cross direction" (CD) is used herein to refer to a direction that is generally perpendicular to the machine direction.

The term "flowable substance" is used herein to refer to a fluid, slurry, and/or suspension that, when placed on a sloped surface (e.g., 20 degrees from the horizontal), outside of a container, would flow or move downwardly via gravity. The fluids, slurries, and/or suspensions may comprise any liquids, such as oils, mineral oils, mineral oil(s) blended with surfactant(s), cleaning substances, fragrancing substances, and/or melted waxes, for example. The flowable substance may have any suitable viscosity, such as about 50 cP to about 150 cP, about 70 cP to about 130 cP, about 80 cP to about 120 cP, about 90 cP to about 110 cP, or about 100 cP, specifically reciting all 0.1 cP increments within the specified ranges and all ranges formed therein or thereby.

The present disclosure is directed to methods and applicator assemblies for applying flowable substances to substrates. The methods and applicator assemblies of the present disclosure may apply any flowable substance to any substrate. Although specific examples of the present disclosure are directed to applying flowable substances to strips of tow fibers, those of skill in the art will acknowledge many other suitable uses with other substrates.

Portions of, or all of, substrates, such as strips of tow fibers, may be coated with flowable substances comprising mineral oil(s) and surfactant(s) and/or other compositions. The flowable substances may be applied to the strips of tow fibers to provide the strips of tow fibers with the ability to better obtain and retain dust and dirt when the strips of tow fibers are used as portions of disposable dusters.

The tow fibers, strips or bundles thereof, referred to herein may be synthetic fibers or any other tow fibers as known to those of skill in the art. "Tow" generally refers to fibers comprising synthetic polymers including polyester, polypropylene, polyethylene, and/or cellulose materials including cellulose acetate and mixtures thereof manufactured such that the individual fibers are relatively long strands manufactured in bundles. The bundle fibers may be defined as any fibers having distinct end points and at least about 1 cm in length.

Frequently, in high speed consumer product manufacturing, a strip of a substrate is conveyed through a line in a machine direction or generally in a machine direction. Flowable substances or components may be added/applied to the strip of the substrate as the strip of the substrate moves in the machine direction. The strip of substrate may comprise one material or two or more materials that are joined together (i.e., a laminate). In one instance, portions of the strips of the tow fibers may be coated with a flowable substance prior to entering a manufacturing line used to form the strips of tow fibers into a portion of a disposable duster.

In an embodiment, referring to FIGS. 1-5, an applicator assembly 10 is illustrated as an example. The applicator assembly 10 may comprise a housing 12. The housing 12 may have any suitable shape and may define a reservoir 14 therein. The housing 12 may be one unitary piece or a plurality of pieces joined together. The reservoir 14 may hold any suitable volume of a flowable substance depending on a particular application and application rate. The housing 12, in an embodiment, may comprise a front wall 16, a first side wall 18, a second side wall 20, a back wall 22, and a bottom wall 24. Internal surfaces of the walls 16, 18, 20, 22, and 24 may together form the reservoir 14. Any of the walls may be flat or may have a shape (e.g., arcuate).

In an embodiment, the applicator assembly 10 may comprise a float 26, at least a portion of which may be configured to contact the flowable substance to determine the amount or level of the flowable substance within the reservoir 14. If the float 26 senses that the flowable substance within the reservoir 14 is too low, it may cause a flowable substance inlet valve 28 in communication with the float 26 to open to cause more flowable substance to enter the reservoir 14. The valve 28 being in communication with the float 26 means generally that the float 26 either mechanically or electrically causes the valve to open and close based on the amount of flowable substance within the reservoir 14. In an embodiment, the float 26 may be mounted to one or more of the walls 16, 18, 20, 22, and 24. The valve 28 may be attached to a portion of the housing 12 or may be formed in or with a portion of the housing 12. In an embodiment, the valve 28 may at least partially extend through one of the walls 16, 18, 20, 22, or 24. Instead of providing the float 26, any other type of fluid level sensing device, assembly, and/or sensor known to those of skill in the art may be used to communicate with (i.e., open and close) the valve 28 electronically or otherwise.

Figure 2:
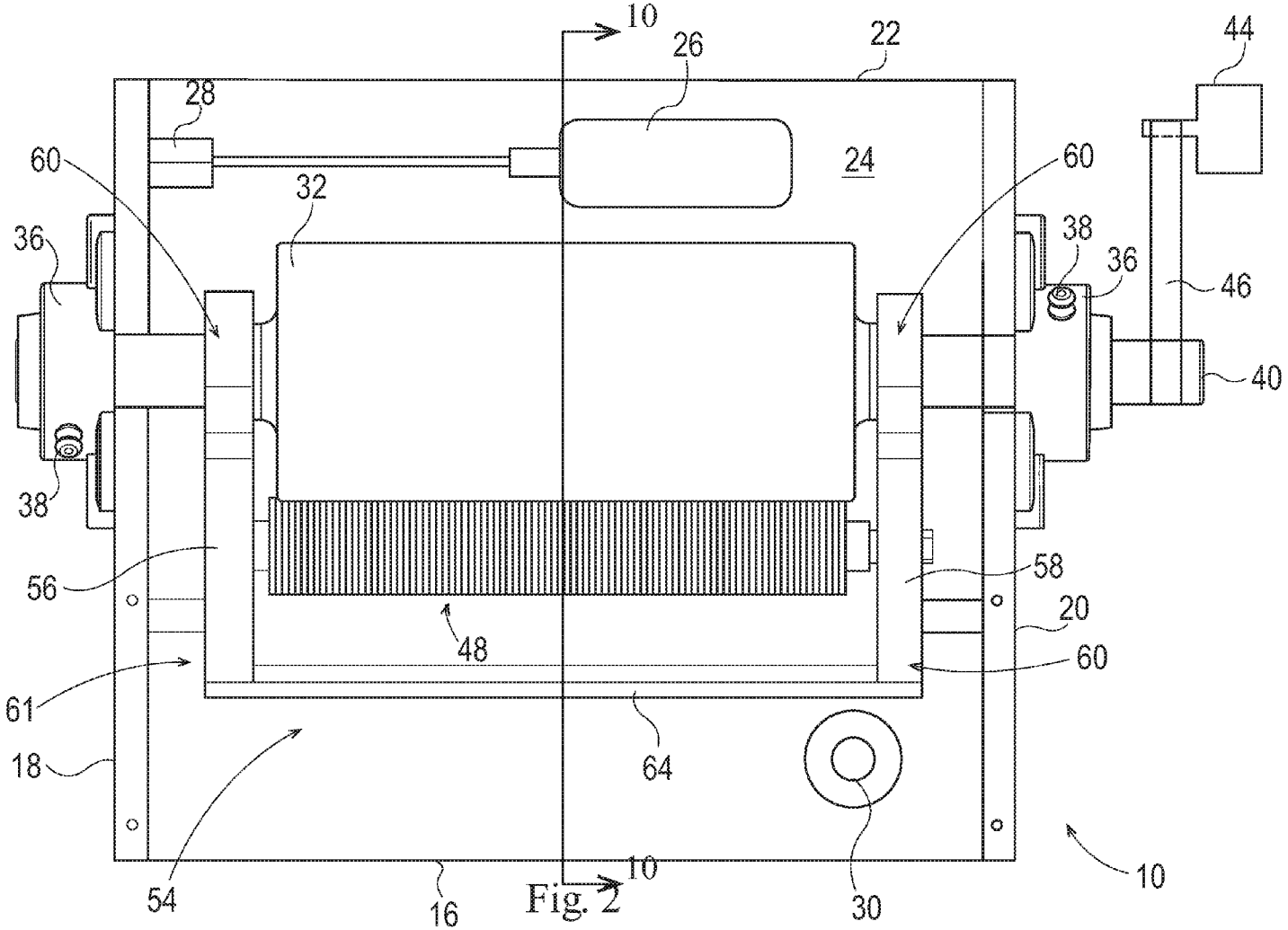
FIG. 2 is a top view of the applicator assembly of FIG. 1 in accordance with a non-limiting embodiment of the present disclosure.
Figure 3:
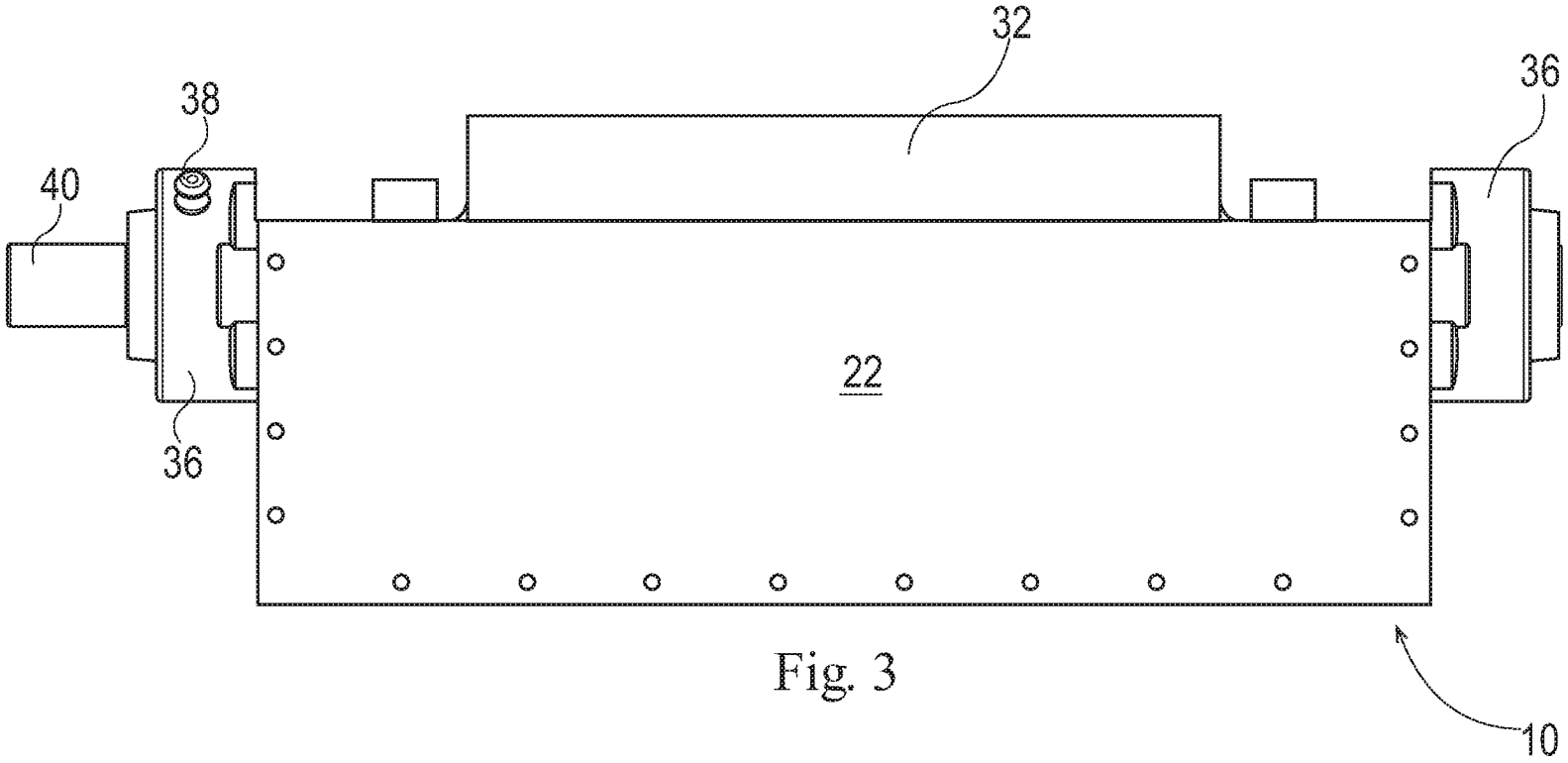
FIG. 3 is a rear view of the applicator assembly of FIG. 1 in accordance with a non-limiting embodiment of the present disclosure.
Figure 4:
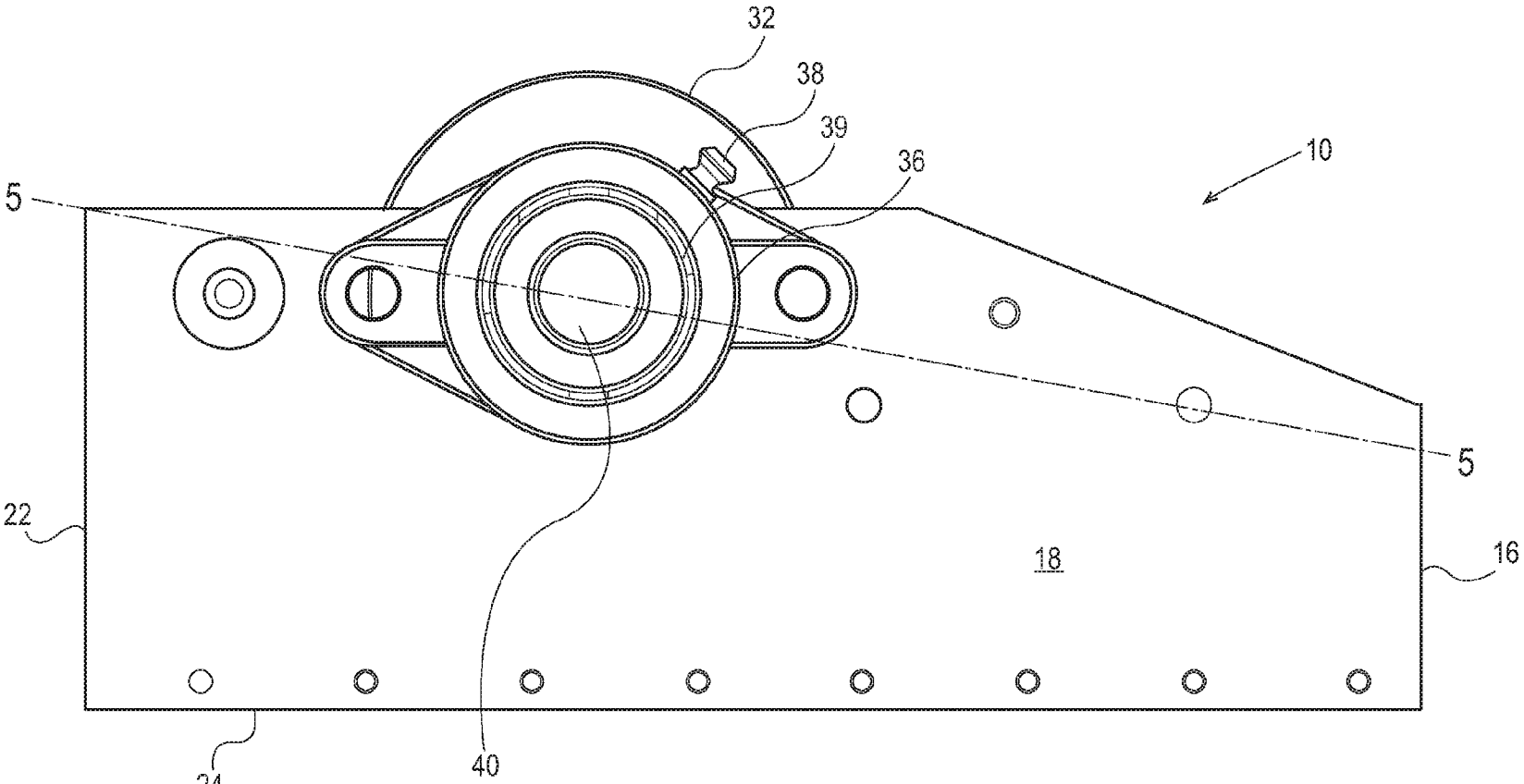
FIG. 4 is a side view of the applicator assembly of FIG. 1 in accordance with a non-limiting embodiment of the present disclosure.
Figure 5:
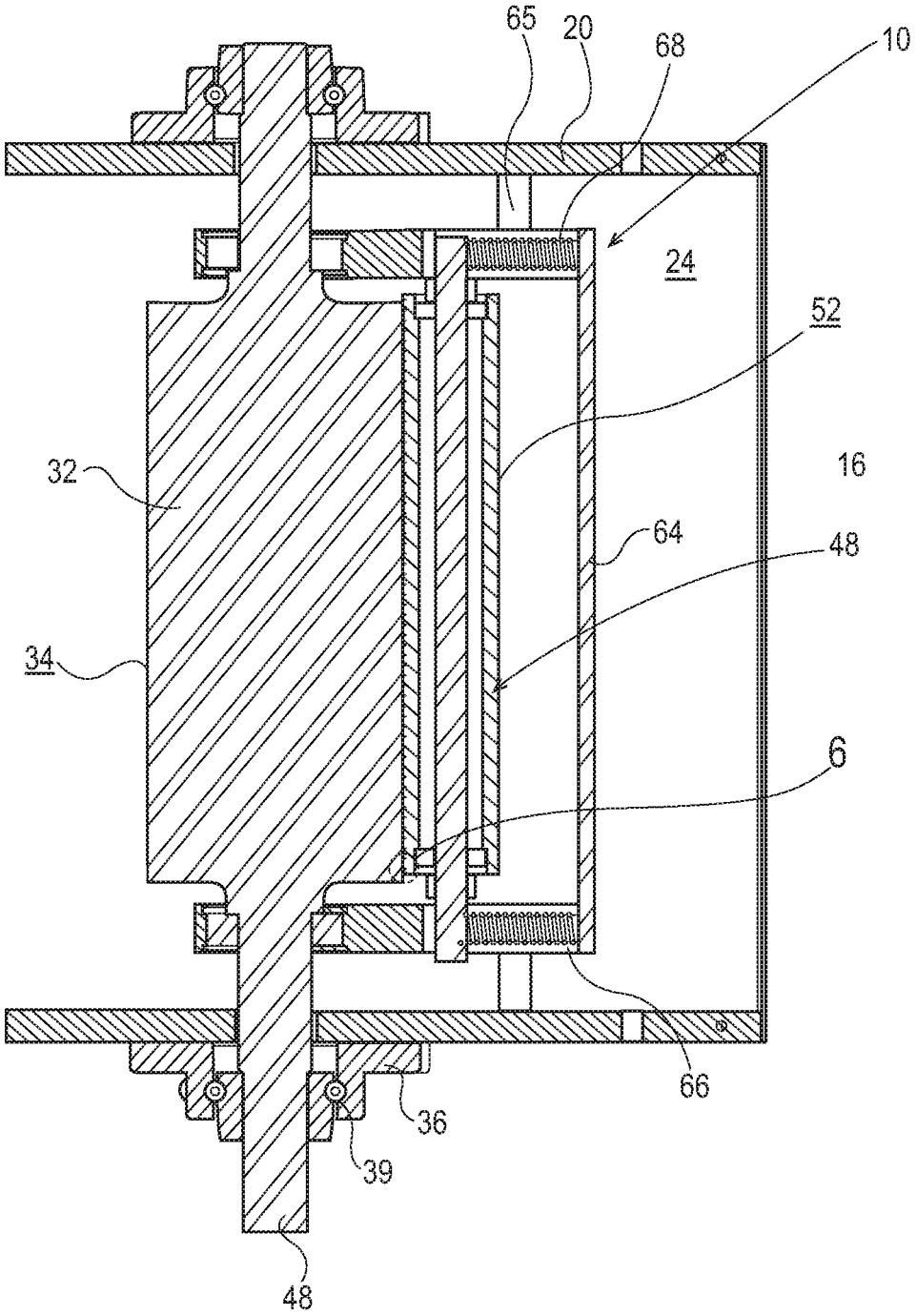
FIG. 5 is a top cross-sectional view of the applicator assembly, taken along line 5-5 of FIG. 4, in accordance with a non-limiting embodiment of the present disclosure.

In an embodiment, referring to FIG. 2, the housing 12 may comprise a drain plug 30 configured to drain the flowable substance from the reservoir 14 at a desirable time for maintenance of the applicator assembly 10 or for other reasons. The applicator assembly 10 may also comprise one or more heating and/or cooling elements (not illustrated) configured to heat and/or cool the flowable substance. The heating and/or cooling elements may further be used to regulate the temperature of the flowable substance during application of the flowable substance to a substrate. In an embodiment, the heating and/or cooling elements may be in contact with the flowable substance to heat and/or cool the flowable substance or may be in thermal communication with the housing 12, or a portion thereof, to heat and/or cool the flowable substance. Other methods of heating and cooling the flowable substance known to those of skill in the art are also within the scope of the present disclosure.

The applicator assembly 10 may comprise an applicator 32, such as a rotating applicator or an applicator roll. The applicator 32 may have any suitable shape, such as a generally cylindrical shape, for example. In an embodiment, the applicator 32 may comprise steel or other material and may have a chrome plated outer surface, although other materials for the applicator 32 are also within the scope of the present disclosure. In an embodiment, the chrome plated, or otherwise plated, outer surface may have a thickness of about 0.01 mm to about 0.2 mm, or about 0.03 mm, specifically reciting all 0.005 mm increments within the recited range and all ranges formed therein. Other thickness of the outer surface may also be used. In an embodiment, the average deviation of the roughness of the outer surface may be about 0.05 micrometers to about 0.7 micrometers or about 0.1 micrometers to about 0.4 micrometers, specifically reciting all 0.001 micrometer increments within the recited ranges and all ranges formed therein or thereby. In general, the applicator 32, if configured in cylindrical form or roll form, may have a radial outer surface 34 that is generally smooth. In other instances, the radial outer surface 34 may comprise projections, ridges, apertures, grooves, and/or recesses defined therein or thereon that provide the radial outer surface 34 with an improved ability, if desired, to acquire the flowable substance from the reservoir 14. The radial outer surface 34 may contact the flowable substance in the reservoir 16 and may be used to apply it to at least a portion of the substrate.

The applicator 32 may be formed with, or fixedly mounted to, a drive shaft 40 such that the applicator 32 may rotate in unison with the drive shaft 40. The applicator 32 may rotate in the direction illustrated by arrow 3 of FIG. 1 or may rotate in the opposite direction. End portions of the drive shaft 40 may be supported by the housing 12 using one or more brackets 36. The brackets 36 may be non-rotatably engaged with the housing 12 (e.g., using bolts). Bearings 39 may be provided at least partially intermediate the end portions of the drive shaft 40 and the brackets 36 to allow the drive shaft 40 to rotate relative to the brackets 36 while still being held in place by the brackets 36. The bearings 39 may be provided with grease, or other lubricant, through one or more grease fittings 38 on the brackets 36. In an embodiment, the housing 12 may define recesses 42 therein, into which the end portions of the drive shaft 40 may extend to be engaged with the brackets 36.

In another embodiment, the drive shaft 40 and applicator 32 may not be engaged with the housing 12 and may instead be positioned proximate to the housing 12 such that the applicator 32 may engage and acquire the flowable substance from the reservoir 14 and apply the flowable substance to a substrate or strip of substrate, such as a strip of tow fibers, for example. In such an instance, the drive shaft 40 may be mounted on one or more ends to a support (not illustrated), wherein the drive shaft 40 may rotate relative to the support and relative to the housing 12.

The drive shaft 40 may be rotated by any suitable actuator 44, such as a motor, operably engage with one of the end portions of, or other portions of, the drive shaft 40 using a belt 46, chain, or other member (see e.g., FIG. 2). Any other suitable methods of engagement of an actuator with a drive shaft or any other method of rotating a drive shaft, known to those of skill in the art, are within the scope of the present disclosure. The drive shaft 40 may be made of the same materials as the applicator 32 or may be made of different materials. In an embodiment, the applicator 32 may be rotatably mounted on a support pin (not illustrated) and rotated relative to the support pin by a drive belt or chain operably engaged with an actuator and the applicator 32, for example.

The applicator 32 may be rotated at any suitable revolutions per minute, no matter how actuated or situated relative to the housing 12. Some example revolutions per minute of the applicator 32 for applying the flowable substance to a substrate or a strip of tow fibers are in the range of about 25 rpms to about 150 rpms or about 10 rpms to about 300 rpms, specifically reciting all 0.1 rpm increments within the specified ranges and all ranges formed therein or thereby. In an embodiment, the surface speed of the applicator 32 where it contacts the substrate may be a percentage of the speed of the substrate. For example, the surface speed of the applicator 32 where it contacts the substrate may be about 25% to about 100%, about 30% to about 70% or about 50% of the speed of the substrate, specifically reciting all 0.5% increments within the specified ranges and all ranges formed therein or thereby.

In an embodiment, referring to FIGS. 1, 2, 5, 6, 7, and 8, the applicator assembly 10 may comprise a metering device 48, such as a metering roll or a metering bar. The metering device 48 may be positioned proximate to a portion of the radial outer surface 34 of the applicator 32. The metering device 48 may be positioned such that it is not immersed in the flowable substance. The metering device 48 may be used to remove a desired amount of the flowable substance from the applicator 32 prior to the applicator 32 applying the flowable substance to a substrate or a strip of tow fibers. After the flowable substance is removed from the applicator 32 by the metering device 48, the flowable substance may drip or run from the metering device 48 back into the reservoir 14. The metering device 48 may comprise one or more grooves 50 defined in a surface or a radial outer surface 52 thereof. In an instance where the metering device 48 is a metering roll, the grooves 50 may extend circumferentially, or at least partially circumferentially, around the metering roll. In other instances, the grooves 50 may not extend circumferentially around the metering roll. In an instance where the metering device 48 is not a metering roll, it may be a metering bar having a plurality of grooves or recesses defined in a surface thereof. The surface of the metering bar may contact the portion of the applicator 32. The metering bar may act similar to the metering roll, but not rotate and instead be fixed. In such an instance, the applicator 32 may rotate relative to the metering bar and the metering bar 32 may act against the applicator 32 to remove a desired amount of the flowable substance therefrom. The position of the metering device 48 may be between the point of flowable substance acquisition and the point of flowable substance application to the substrate 70.

In an embodiment, the metering device 48 may be biased toward the applicator 32 and/or the applicator 32 may be biased toward the metering device 48 using any suitable biasing techniques known to those of skill in the art. The biasing allows the metering device 48 to engage a surface of the applicator 32 and remove a portion of the flowable substance therefrom. The area of the metering device 48 not comprising the grooves 50 forms the portion of the metering device 48 that removes the flowable substance from the applicator roll 32 owing to the contact between the metering device 48 and the flowable substance on the applicator roll 32 at these locations. The area of the metering device 42 within the grooves 50 allows the flowable substance to remain on the applicator 32. As a result, more grooves and/or larger grooves may result in more of the flowable substance on the applicator 32 and, therefore, more of the flowable substance being applied to the substrate Likewise, less grooves and/or smaller grooves may result in less of the flowable substance on the applicator 32 and, therefore, less of the flowable substance being applied to the substrate.

Figure 6:
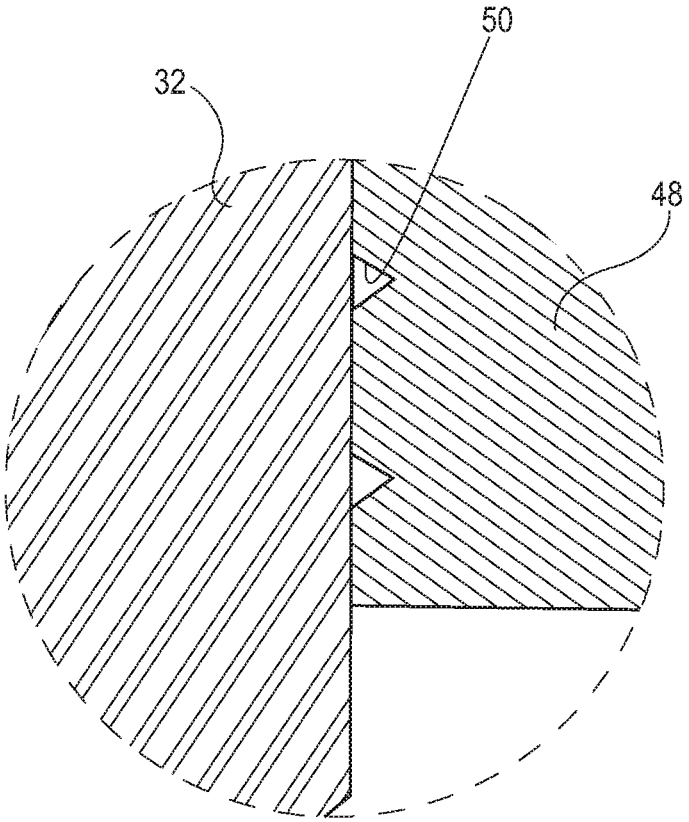
FIG. 6 is a detail view of a portion of a metering device and a portion of an applicator of the applicator assembly, taken from detail 6 of FIG. 5, in accordance with a non-limiting embodiment of the present disclosure.
Figure 8:
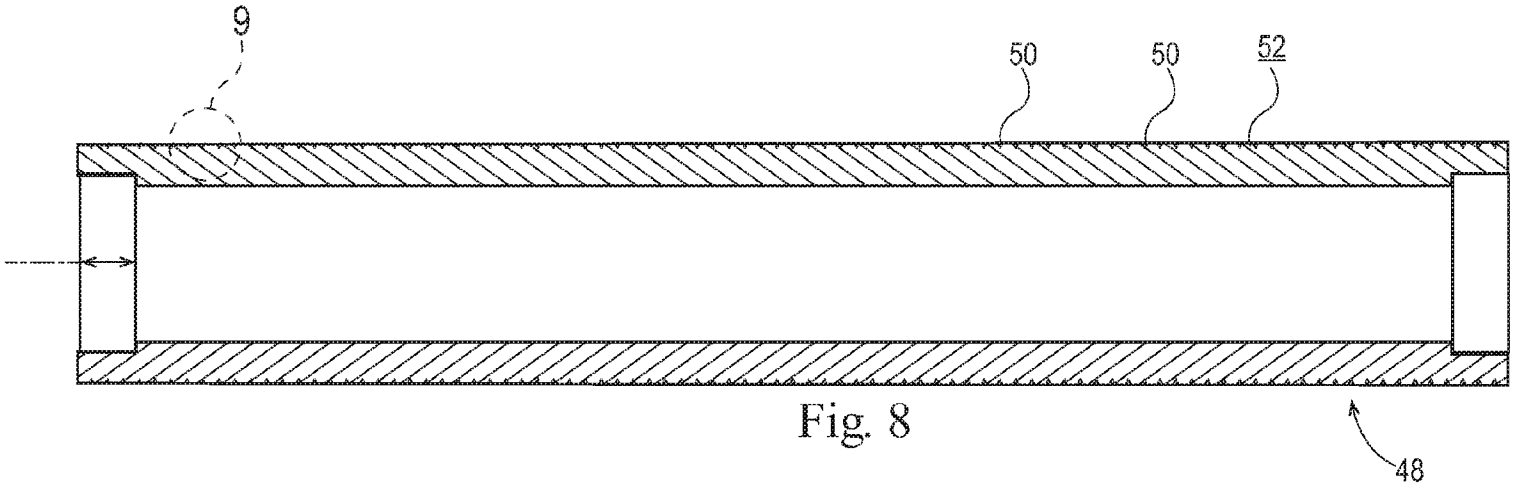
FIG. 8 is a cross-sectional view of the metering device, taken along line 8-8 of FIG. 7, in accordance with a non-limiting embodiment of the present disclosure.
Figure 7:
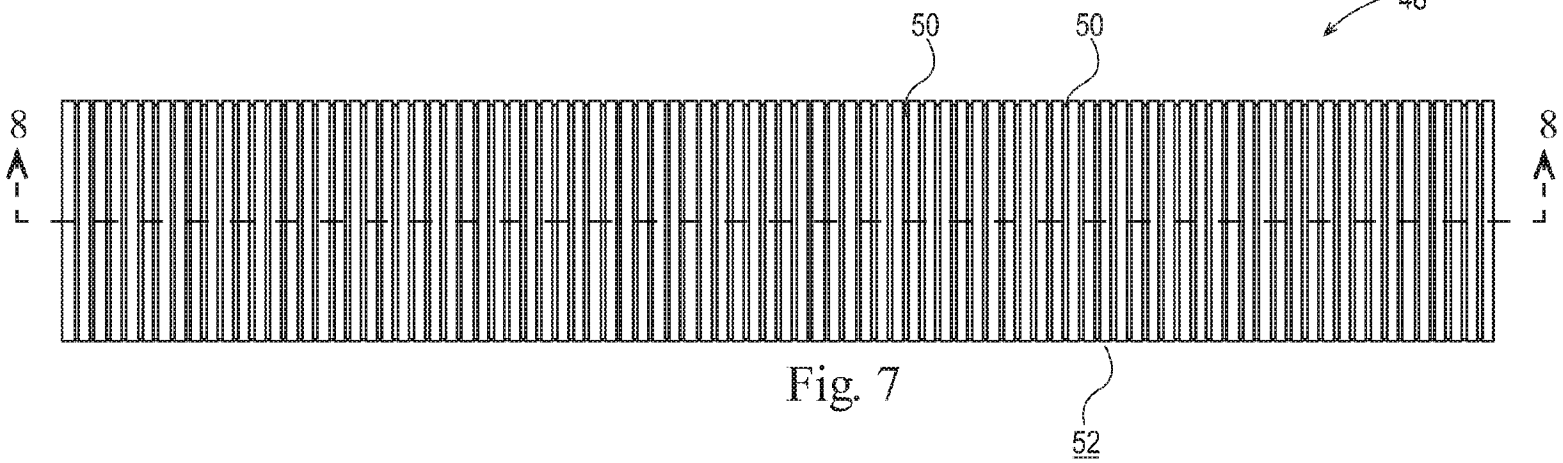
FIG. 7 is a front view of a metering device of the applicator assembly in accordance with a non-limiting embodiment of the present disclosure.
Figure 9:
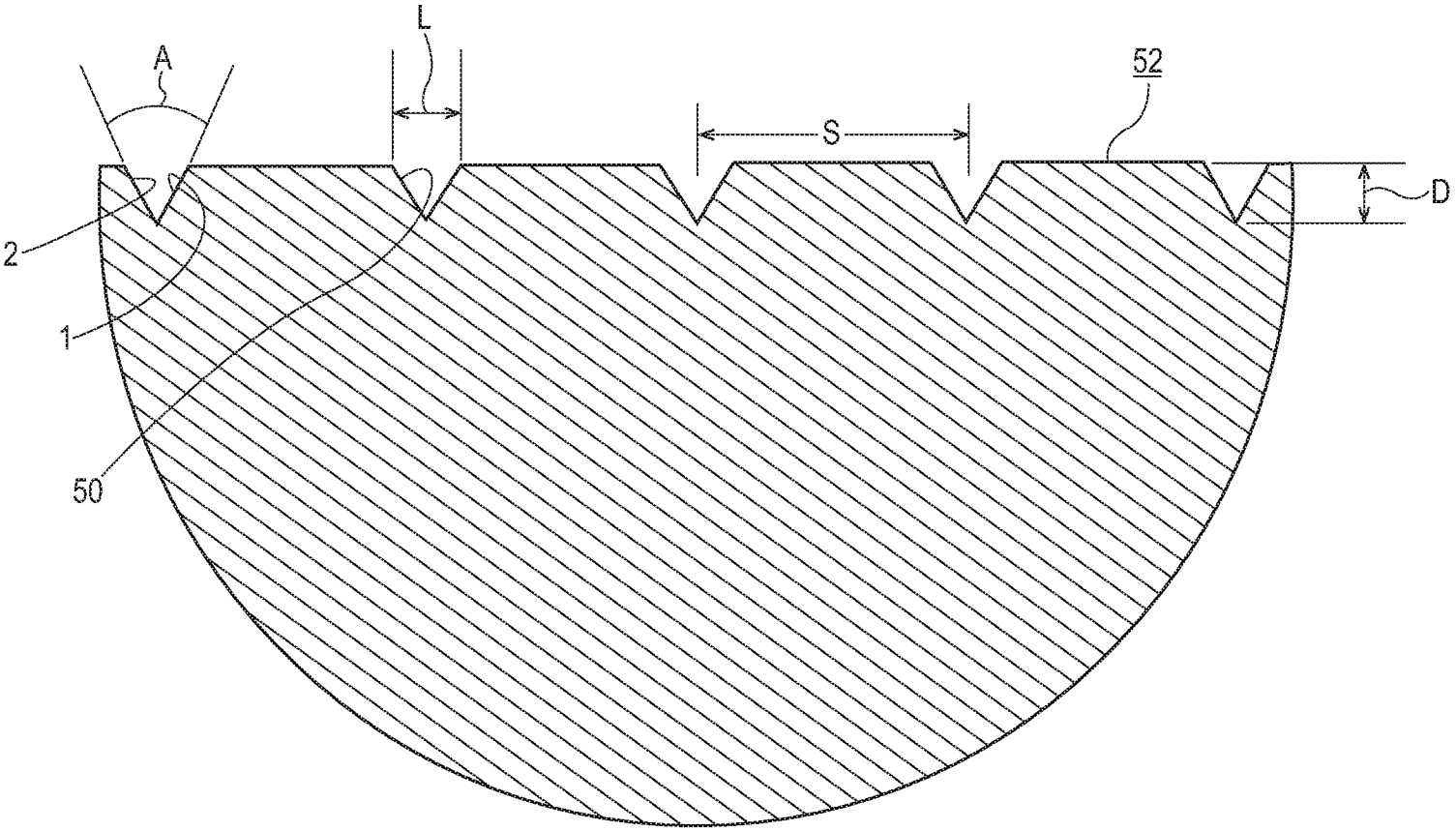
FIG. 9 is a detail view of a portion of a metering device, taken from detail 9 of FIG. 8, in accordance with a non-limiting embodiment of the present disclosure.

In an embodiment, the grooves 50 may have any suitable cross-sectional shape, such as a triangular cross-sectional shape as illustrated, for example, in FIG. 6-9. Other suitable cross-sectional shapes may be square, rectangular, ovate, other shapes, or may comprise arcuate portions. FIG. 6 illustrates a detail view of the engagement of a portion of the applicator 32 with a portion of the metering device 48 taken about detail 6 of FIG. 5. FIG. 7 illustrates a front view of the metering device 48 having a plurality of grooves 50 defined therein. FIG. 8 illustrates a cross-sectional view of the metering device 48 taken about line 8-8 of FIG. 7. FIG. 9 illustrates a detail view taken from detail 9 of FIG. 8.

The grooves 50 may have any suitable depth from a surface (e.g., the radial outer surface 52) into which they are defined to the most distal (inner) portion of the groove 50. FIG. 9 illustrates how a groove depth, D is measured. Example groove depths, D, may be in the range of about 0.1 mm to about 10 mm, about 0.3 mm to about 5 mm, about 0.4 mm to about 5 mm, about 0.4 to 1.0 mm, about 0.5 mm, about 0.55 mm, or about 0.6 mm, specifically reciting all 0.05 mm increments within the specified ranges and all ranges formed therein or thereby. The depths of various grooves 50 in the metering device 48 may be the same or different. The grooves 50 may have any suitable lengths taken parallel to a longitudinal axis of the metering device 48. The lengths of various grooves may be the same or different. Example lengths, L, (as illustrated in FIG. 9) may be about 0.1 mm to about 5 mm, about 0.2 mm to about 5 mm, about 0.3 mm to about 5 mm, about 0.4 mm to about 3 mm, about 0.5 mm to about 2 mm, specifically reciting all 0.1 mm increments within the specified ranges and all ranges formed therein or thereby. The lengths of various grooves 50 in the metering device 48 may be the same or different. The grooves 50 may have any suitable spacing relative to each other longitudinally about the longitudinal axis of the metering device 48. Example spacing, S, intermediate the various grooves (taken in a direction parallel to the longitudinal axis of the metering roll 48 as indicated by S in FIG. 9) may be in the range of about 1 mm to about 10 mm, about 2 mm to about 10 mm, about 3 mm to about 8 mm, or about 2 mm to about 4 mm, specifically reciting all 0.1 mm increments within the specified ranges and all ranges formed therein or thereby. The longitudinal spacing between each of the grooves 50 may be the same or different and may vary depending on the length, L, of each of the grooves. Grooves having larger lengths may have greater spacing therebetween than grooves having smaller lengths, for example. In an embodiment, more grooves may be present in particular portions of the metering device 48 than in other portions of the metering device 48 (e.g., more grooves in the longitudinal central portion, or other portions, of the metering device). Those of skill in the art will recognize that the grooves 50, their dimensions, and spacing relative to each other, may be varied to meter a desired portion of the flowable substance from the applicator 32. In some instances, the biasing force between the applicator 32 and the metering device 48 may be varied to remove a desired amount of the flowable substance from the applicator 32.

In an embodiment, if the grooves 50 have a triangular cross-sectional shape, as illustrated in FIG. 9, the angles, A, formed by two sides of the triangle (sides indicated as 1 and 2 in FIG. 9) may be in the range of about 20 degrees to about 80 degrees, about 40 degrees to about 70 degrees, about 50 degrees to about 70 degrees, about 55 degrees to about 65 degrees, about 50 degrees, about 55 degrees, about 60 degrees, about 65 degrees, or about 70 degrees, specifically reciting all 0.5 degree increments within the above-specified ranges and all ranges formed therein or thereby. In an embodiment, the grooves 50 may also comprise radiused grooves or flat castellated grooves having similar dimensions and/or angles as specified herein.

In an embodiment, the grooves 50 may or may not extend perpendicular to the longitudinal axis of the metering device 48. In an instance, the grooves 50 may extend in a direction transverse to the longitudinal axis of the metering device 48. In other instances, the grooves 50 may not extend circumferentially around the metering device 48 if the metering device 48 is a metering roll, but instead may only partially extend circumferentially around the metering roll. In still other instances, the grooves may extend in a direction generally parallel with the longitudinal axis of the metering device 48.

In yet another embodiment, grooves may not be provided on the metering device 48 and, instead, the amount of the flowable substance removed from the applicator 32 may be controlled, at least in part, by the biasing force between the metering device 48 and the applicator 32. Stated another way, the metering device 48 and the applicator 32 may create a nip, N, therebetween (see e.g. FIG. 10), wherein the nip is configured to reduce the thickness of the flowable substance to a desired thickness (e.g., reduce the thickness of the flowable substance to 2 mm from 1 mm, for example). In other instances, the surface contour (not grooves) of the metering device 48 and/or the applicator 32 may control the amount of the flowable substance removed from the applicator 32 and/or accumulated on the applicator 32. Those of skill in the art will understand that other metering techniques and apparatuses are also within the scope of the present disclosure, such as engaging a piece of material against the applicator 32 that may act like a squeegee. The squeegee may be continuous or discontinuous in the portion that would contact the applicator 32.

In an embodiment, referring to FIGS. 1-3 and 5, the applicator assembly 10 may comprise a support 54. The support 54 may comprise a first support portion 56 and a second support portion 58. The support 54 may be used to hold the metering device 48 relative to the applicator 32 and/or to bias the metering device 48 against a portion of a surface of, or the radial outer surface 34 of, the applicator 32. The first and second support portions 56, 58 may each comprise a first end 60 engaged with the drive shaft 40. One or more bearings 62 may be supplied intermediate the first ends 60 and the drive shaft 40, such that the drive shaft 40 may rotate relative to the first ends 60. Stated another way, the support 54 may be generally non-rotatably fixed in position relative to the housing 12 and the drive shaft 60 may be permitted to rotate relative to the first ends 60 owing to the bearings 62. Other methods of engaging the first ends 60 to the drive shaft 40, instead of using the bearings 62 are also within the scope of the present disclosure. In still other instances, a support may not have first ends engaged with the drive shaft 40 and instead the support may be fixedly engaged with the housing 12 or may merely be positioned relative to the applicator 32 such that the metering device 48 may be engaged with a surface, or the radial outer surface 34, of the applicator 32. The first and second portions 56 and 58 of the support 54 may be connected by a bar 64 on second ends 61 thereof and may be engaged with the housing 12 using one or more connectors 65. In another embodiment, the metering device 48 may be mounted to the housing 12, such as rotatably mounted to the housing 12, so that at least a portion of the metering device 48 is able to contact a portion of the applicator 32.

As discussed above, the metering device 48 may be biased towards the applicator 32 and/or the applicator 32 may be biased toward the metering device 48. The biasing force intermediate the applicator 32 and the metering device 48 may be in the range of about 0.5 kg to about 10 kg, about 1 kg to about 7 kg, or about 1 kg to about 5 kg, or about 1 kg, specifically reciting all 0.1 kg increments within the specified ranges and all ranges formed therein or thereby. Those of skill in the art will recognize that any other suitable biasing forces may be used to property meter a desired amount of the flowable substance off of the applicator 32 prior to the applicator 32 applying the remaining flowable substance to a substrate. In an embodiment where the metering device 48 is biased toward the applicator 32 or the applicator 32 is biased towards the metering device 48, the applicator 32 may drive the metering device 48 (i.e., cause it to rotate if it is a metering roll). The applicator 32 and the metering device 48 may have any suitable diameters, although generally the applicator 32 may have a greater diameter than the metering device 48.

Figure 10:
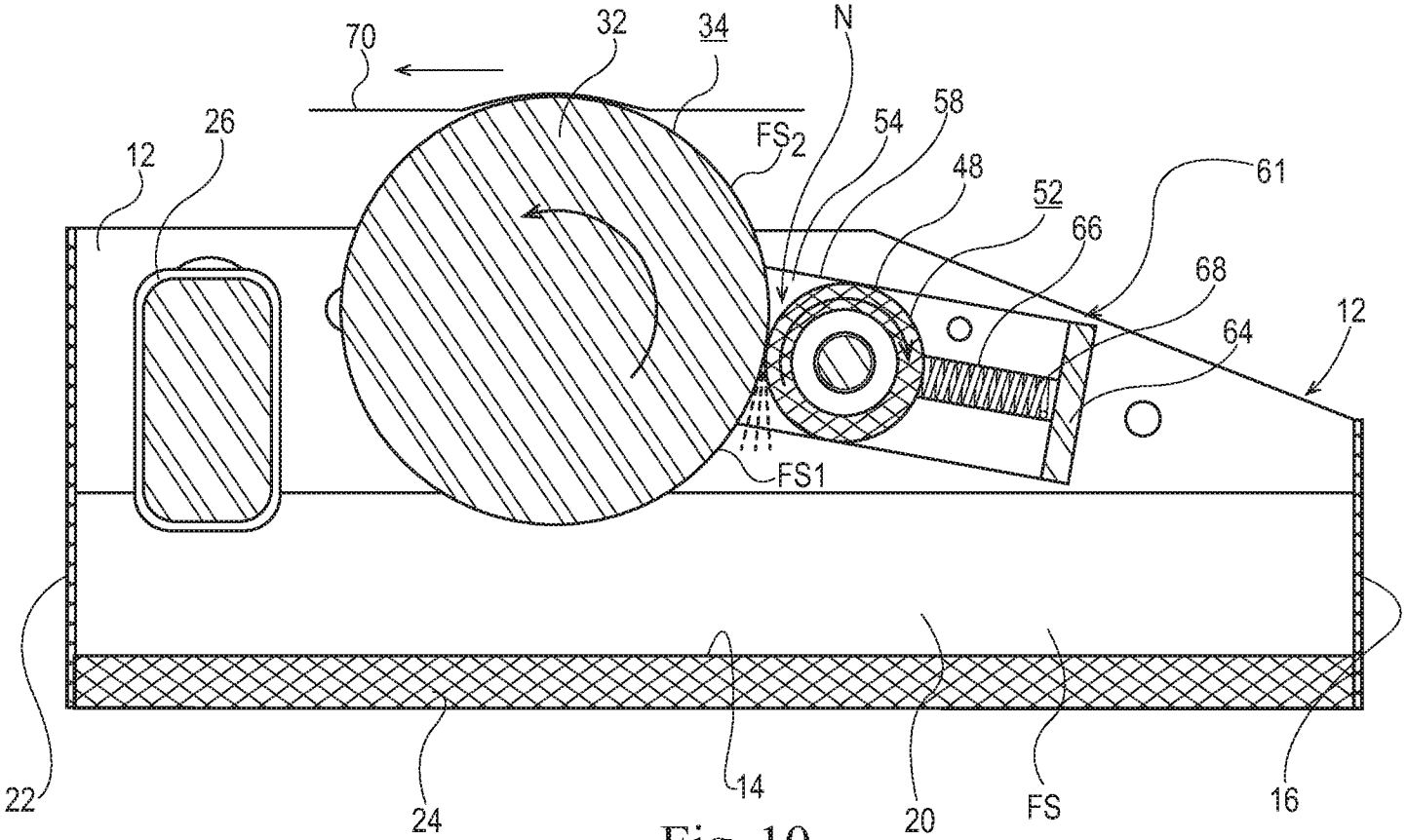
FIG. 10 is a cross-sectional view of the applicator assembly of FIG. 2, taken along line 10-10 of FIG. 2, in accordance with a non-limiting embodiment of the present disclosure.

In an embodiment, referring to FIG. 10, the metering device 48 may be biased towards the applicator 32 by providing elongate slots 66 in both of the first and second support portions 56 and 58. Ends of the metering device 48 may be slidably engaged with the slots 66 in directions generally toward and away from the applicator 32. A biasing member 68, such as a compression spring or a compressed air cylinder, for example, may be positioned at least partially within each of the slots 66. The biasing members 68 may each act against end portions or walls of the slots 66 on one end and may act against and/or be engaged with the ends of the metering device 48 within the slots 66 on the other end to bias the metering device 48 in a direction toward the applicator 32. Other methods of creating a biasing force between the metering device 48 and the applicator 32 will be recognized by those of skill in the art. In still other instances, no biasing force may be applied between the metering device 48 and the applicator 48 and instead the applicator 32 or the metering device 48 may comprise a resilient surface that can be deformed when the applicator 32 contacts the metering device 48. Again referring to FIG. 10, the flowable substance, FS, is illustrated within the reservoir 14 formed by portions of the housing 12. The flowable substance is accumulated by the applicator 32 at a thickness of $FS_1$. The flowable substance is then run through the nip, N, intermediate the metering device 48 and the applicator 32 wherein the thickness of the flowable substance is thinned to thickness $FS_2$. The excess flowable substance drips or runs back into the reservoir 14 as illustrated in FIG. 10. The flowable substance remaining on the applicator 32, or a portion thereof, is then applied to the substrate 70 while having the thickness $FS_2$.

The present disclosure is also directed, in part to a method of applying a flowable substance to a substrate, such as a strip of tow fibers or other materials. The method may comprise conveying the substrate 70 over a portion of the applicator assembly 10 (see e.g., FIGS. 1 and 10). The substrate 70 may be conveyed over the applicator assembly 10 at any suitable speed for a particular flowable substance application. As the substrate 70 is conveyed over the application assembly 10, it may contact a portion of, or the radial outer surface 34 of, the rotating applicator 32 such that the flowable substance may be applied to a portion of the substrate 70. The substrate 70 may contact the portion of the rotating applicator 32 in a direction generally perpendicular to, or transverse to, the longitudinal axis of the rotating applicator 32 (i.e., the longitudinal axis of the drive shaft 40). The portion of the rotating applicator 32 may be at least at partially immersed in the flowable substance within the reservoir 14 to accumulate the flowable substance on the portion of the rotating applicator 32. The portion of the rotating applicator 32, or radial outer surface 34 of the rotating applicator 32, may be immersed in the flowable substance (i.e., from a top surface of the flowable substance) within the reservoir 14 at least 1 mm or in the range of about 1 mm to about 12 mm, about 2 mm to about 10 mm, about 3 mm to about 9 mm, or about 2 mm to about 5 mm, specifically reciting all 0.1 mm increments within the specified ranges and all ranges formed therein or thereby. Other depths of immersion are also within the scope of the present disclosure depending on the specific flowable substance used and the particular flowable substance application desired. The portion of the rotating applicator 32 that accumulates the flowable substance may be engaged with a portion of the metering device 48 prior to the flowable substance being applied to a portion of the substrate 70. As discussed herein, the metering device 48 may comprise a plurality of grooves 50 defined in a surface or the radial outer surface 34 thereof. The metering device 48 may be configured to meter a portion of the accumulated flowable substance on the portion of the rotating applicator 32 off of the portion of the rotating applicator 32 so as to apply the correct amount of the flowable substance to the substrate 70. The method may further comprise applying a portion of, or substantially all of, the remaining flowable substance on the portion of the rotating applicator 32 to the portion of the substrate 70 when the portion of the substrate contacts the portion of the rotating applicator 32 and after the flowable substance is metered from the portion of the rotating applicator 32.

In an embodiment, the applicator 32 may comprise a raised middle portion (i.e., raised radially outward with respect to the longitudinal axis of the applicator 32), wherein only the raised middle portion contacts the flowable substance, the metering device 48, and the substrate 70. This feature may be helpful when the substrates being coated are fairly narrow (i.e., not as wide as the applicator 32). The raised middle portion may be formed with the applicator 32 or may be attached to the radial outer surface 34 of the applicator 32. In other embodiments, the applicator 32 may be convex from a first end to a second end such that the middle portion extends more radially outwardly than the side portions again so that only the middle portion contacts the flowable substance, the metering device 48, and the substrate 70. In such an instance, the metering device 48 may be concave at least in a middle portion to complement the convex middle portion of the applicator 32.

The rotating applicator 32 may be a rotating applicator roll and the metering device 48 may be a rotating metering roll. The plurality of grooves 50 may be formed in a radial outer surface 52 of the metering roll. At least one of the plurality of grooves 50 may extend at least partially, or fully, circumferentially around the metering roll. The rotating applicator roll may be rotated in a first direction and the metering roll may be rotated in a second direction that is generally opposite to the first direction. In an embodiment, the metering roll may be driven by an actuator instead of, or in addition to, the applicator 32 being rotated by an actuator.

The conveying of the substrate step may comprise conveying the substrate 70 at a first speed. The rotating applicator 32 may have a second surface speed at the point, or points, it contacts the substrate 70. The first speed may be faster than, slower than, equal to, or substantially equal to the second surface speed. In general, in some embodiments, it may be desirable to have the first speed be greater than, equal to, or substantially equal to, the second surface speed. As an example, the first speed may be in the range of about 10 m/min to about 100 m/min or of about 25 m/min to about 75 m/min, specifically reciting all 0.1 m/min increments within the specified ranges and all ranges formed therein or thereby. The second surface speed may be in the range of about 2.5 m/min to about 100 m/min, of about 3 m/min to about 70 m/min, or about 5 m/min to about 50 m/min, specifically reciting all 0.1 m/min increments within the specified ranges and all ranges formed therein or thereby.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, those of skill in the art will recognize that various other changes and modifications can be made without departing from the spirit and scope of the invention. It is therefore intended to cover in the appended claims all such changes and modifications that are within the scope of this invention.

What is claimed is:

1. A method of applying a flowable substance to a strip of tow fibers, the method comprising:

conveying the strip of tow fibers;

contacting a portion of the strip of tow fibers with a portion of a rotating applicator as the strip of tow fibers is conveyed;

immersing the portion of the rotating applicator in flowable substance to accumulate the flowable substance on the portion of the rotating applicator, the flowable substance comprising oils, mineral oils, mineral oil(s) blended with surfactant(s), cleaning substances, fragrancing substances, and/or melted waxes, wherein the viscosity of the flowable substance is in the range of about 70 cP to about 130 cP, wherein the immersing step comprising immersing an outer radial surface of the portion of the rotating applicator in the flowable substance in a range of about 2mm to about 10mm deep;

engaging a metering device with the portion of the rotating applicator, wherein the metering device comprises a plurality of circumferential grooves formed in a surface thereof;

biasing a portion of the metering device against a radial outer surface of the rotating applicator wherein the biasing has a force in the range of 1kg to 5kg;

metering a portion of the accumulated flowable substance on the portion of the rotating applicator off of the portion of the rotating applicator using the metering device; and applying a portion of the remaining flowable substance on the portion of the rotating applicator to the portion of the strip of tow fibers when the portion of the strip of tow fibers contacts the portion of the rotating applicator.

2. The method of claim 1, wherein the rotating applicator is a rotating applicator roll, wherein the metering device is a metering roll, wherein the plurality of grooves are formed in a radial outer surface of the metering roll, and wherein at least one of the plurality of grooves circumferentially extends around the metering roll.

3. The method of claim 2, comprising rotating the rotating applicator roll in a first direction and rotating the metering roll in a second direction that is generally opposite to the first direction.

4. The method of claim 1, wherein the conveying step comprises conveying the strip of tow fibers at a first speed, comprising rotating the rotating applicator such that that the portion of the rotating applicator contacting the strip of tow fibers has a second surface speed, and wherein the first speed is faster than the second surface speed.

5. The method of claim 1, wherein the conveying step comprises conveying the strip of tow fibers at a first speed, comprising rotating the rotating applicator such that the portion of the rotating applicator contacting the strip of tow fibers has a second surface speed, and wherein the first speed is substantially equal to the second surface speed.

6. The method of claim 1, comprising rotating the metering device using the rotating applicator.

7. The method of claim 1, wherein the contacting of the portion of the strip of tow fibers with the rotating applicator occurs in a direction generally perpendicular to a longitudinal axis of the rotating applicator.

8. The method of claim 1, wherein the contacting of the portion of the strip of tow fibers with the rotating applicator occurs in a direction transverse to a longitudinal axis of the rotating applicator.

9. The method of claim 1, comprising driving the rotating applicator using an actuator operably engaged with a drive shaft, wherein the rotating applicator is fixedly engaged with or formed with the drive shaft such that the rotating applicator rotates in unison with the drive shaft.

* * * * *